US005139286A

United States Patent [19]

Gold

[11] Patent Number: 5,139,286

[45] Date of Patent: * Aug. 18, 1992

[54] RETAIL COUPONING SYSTEMS WITH IMPROVED COUPON SEPARATION

[76] Inventor: Raymond Gold, 1846 W. Highland St., Chandler, Ariz. 85224

[ * ] Notice: The portion of the term of this patent subsequent to Oct. 1, 2008 has been disclaimed.

[21] Appl. No.: 705,427

[22] Filed: May 24, 1991

[51] Int. Cl.[5] ..... B42D 15/00

[52] U.S. Cl. ..... 285/105; 283/51; 283/56; 283/101; 283/106; 283/901

[58] Field of Search ..... 283/101, 105, 56, 51, 283/72, 100, 103, 106, 901; 40/299, 638

[56] References Cited

U.S. PATENT DOCUMENTS

| | | | |
|---|---|---|---|
| 3,582,111 | 6/1971 | Siiter | 283/56 |
| 3,900,219 | 8/1975 | D'Amato et al. | 283/101 |
| 4,722,554 | 2/1988 | Pettit | 283/105 |
| 4,852,912 | 8/1989 | Engel | 283/105 |
| 5,052,718 | 10/1991 | Gold | 283/105 |

*Primary Examiner*—Timothy V. Eley
*Assistant Examiner*—Willmon Fridie, Jr.
*Attorney, Agent, or Firm*—Caesar, Rivise, Bernstein, Cohen & Pokotilow, Ltd.

[57] ABSTRACT

A couponing system by which a consumer selects one of two coupons, hidden from the consumer, by pulling one of two, non-intersection zipper pulls which shears, destroys and renders invalid the non-selected coupon, while keeping intact the selected coupon.

20 Claims, 5 Drawing Sheets

RETAIL COUPONING SYSTEMS WITH IMPROVED COUPON SEPARATION

RELATED APPLICATION

This application describes and claims improvements to the Retail Couponing System disclosed in U.S. application Ser. No. 617,504, filed Nov. 3, 1990, the subject matter of which is hereby incorporated herein by reference.

FIELD OF THE INVENTION

The present invention relates, in general, to retail coupons and, in particular, to multiple value coupons of the so-called "option" or "self-destruct" type.

BACKGROUND OF THE INVENTION

Consumer packaged goods companies are always looking for effective ways to increase the market share of their brands. The "option" or "self-destruct" retail coupon is one such technique. The consumer is encouraged to purchase more product or convert from a competitor's product. The "option" or "self-destruct" retail coupon is arranged with multiple coupons, one of which is to be selected by the consumer. When the selection is made, the selected coupon remains intact as a coupon and can be redeemed at the store, while the non-selected coupon is destroyed and the non-selected coupon is rendered invalid, thereby negating double redemption. A coupon is rendered invalid when it lacks the legal terms and conditions covering the consumer redemption conditions and retailer reimbursement text.

Various designs for option or self-destruct coupons have been suggested or put into actual use. Generally, they have not been adequately satisfactory in accomplishing their intended purpose. The manner in which the option or self-destruct coupon is to be used might not be clearly understood by the consumers. The arrangement of the coupons can confuse the consumer. The invalidation of the non-selected coupon might be inadequate, so that the "destroyed" coupon retains the appearance of a valid coupon. The design may foster or cause the inadvertent and unintentional destruction of the wrong coupon.

Besides consumer confusion if the multiple coupon is not understood and the desired coupon is not removed correctly, there can be even more confusion at the check-out counter of the store where the consumer is seeking redemption of the coupon.

Applicant has invented a unique couponing system which is the subject matter of copending application Ser. No. 617,504, titled "Retailed Couponing System." That system has first and second sections attached to each other along their edges to hide from view text on the inside surface of the first section. The first section has first and second coupons on its inside surface and means for tearing the first section along first and second lines extending transversely to each other and for the full length (and width) of the first section. The first line extends through the first coupon and is displaced from the second coupon, and the second line extends through the second coupon and is displaced from the first coupon.

Although the couponing system disclosed in applicant's '504 application generally is satisfactory for its intended purpose, a more tenacious attachment of the first section to the second section would be desirable. Also, a reasonably high degree of care needs to be exercised to prevent the line of tear from deviating from the first or second lines, and possibly entering and damaging the wrong coupon.

SUMMARY OF THE INVENTION

A couponing system has first and second sections attached to each other to hide from view text on the inside surface of the first section. The first section has a first dimension defined between a first pair of spaced-apart edges and a second dimension defined between a second pair of spaced-apart edges. The first section has first and second coupons with text of the coupons on the inside surface. The first and second coupons each include a first edge extending along an edge of a pair of spaced-apart edges of the first section and being dimensioned to included a second edge terminating inwardly of the other edge of the pair of spaced-apart edges of the first section. The first and second sections are secured together in regions outside the boundaries of the first and second coupons and contiguous to the second edges of the first and second coupons. The second edges of the first and second coupons are each provided by a line of weakness through the first section along which the first and second coupons can be separated from the first section. A means for tearing the first section along first and second lines is provided, with the first line being displaced from the second coupon, and extending through the first coupon from the first edge of the first coupon to the second edge of the first coupon, and terminating adjacent to the region in which the first and second sections are secured together contiguous to the second edge of the first coupon. The second line is displaced from the first coupon and extends through the second coupon from the first edge of the second coupon to the second edge of said second coupon and terminates adjacent to the region in which the first and second sections are secured together contiguous to the second edge of the second coupon.

In a preferred embodiment of this invention the tearing means include a first zipper pull extending along the first line and second zipper pull extending along the second line.

Most preferably each of the first and second zipper pulls each have spaced-apart side edges defined by lines of weakness, a forward pulling edge adapted to be gripped and pulled by a user, said forward pulling edge being adjacent one of the first and second edges of the coupon through which the zipper pull extends and a rear base adjacent the other of the first and second edges of the coupon through which the zipper pull extends.

BRIEF DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE INVENTION

Figure 1:
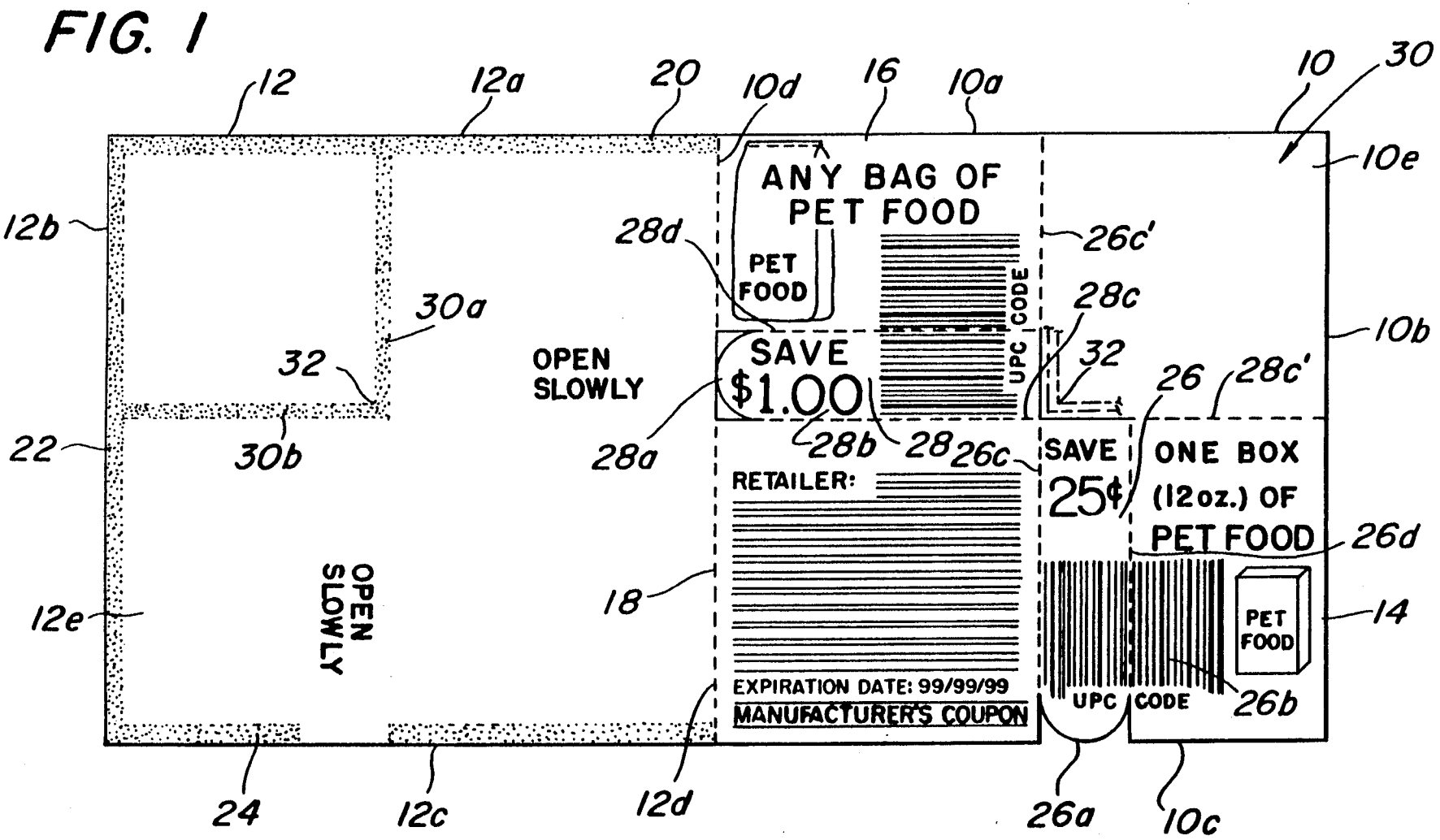
FIG. 1 is a plan view of a first preferred embodiment of a couponing system constructed in accordance with the present invention prior to its formation into a product as it is actually used.
Figure 2:
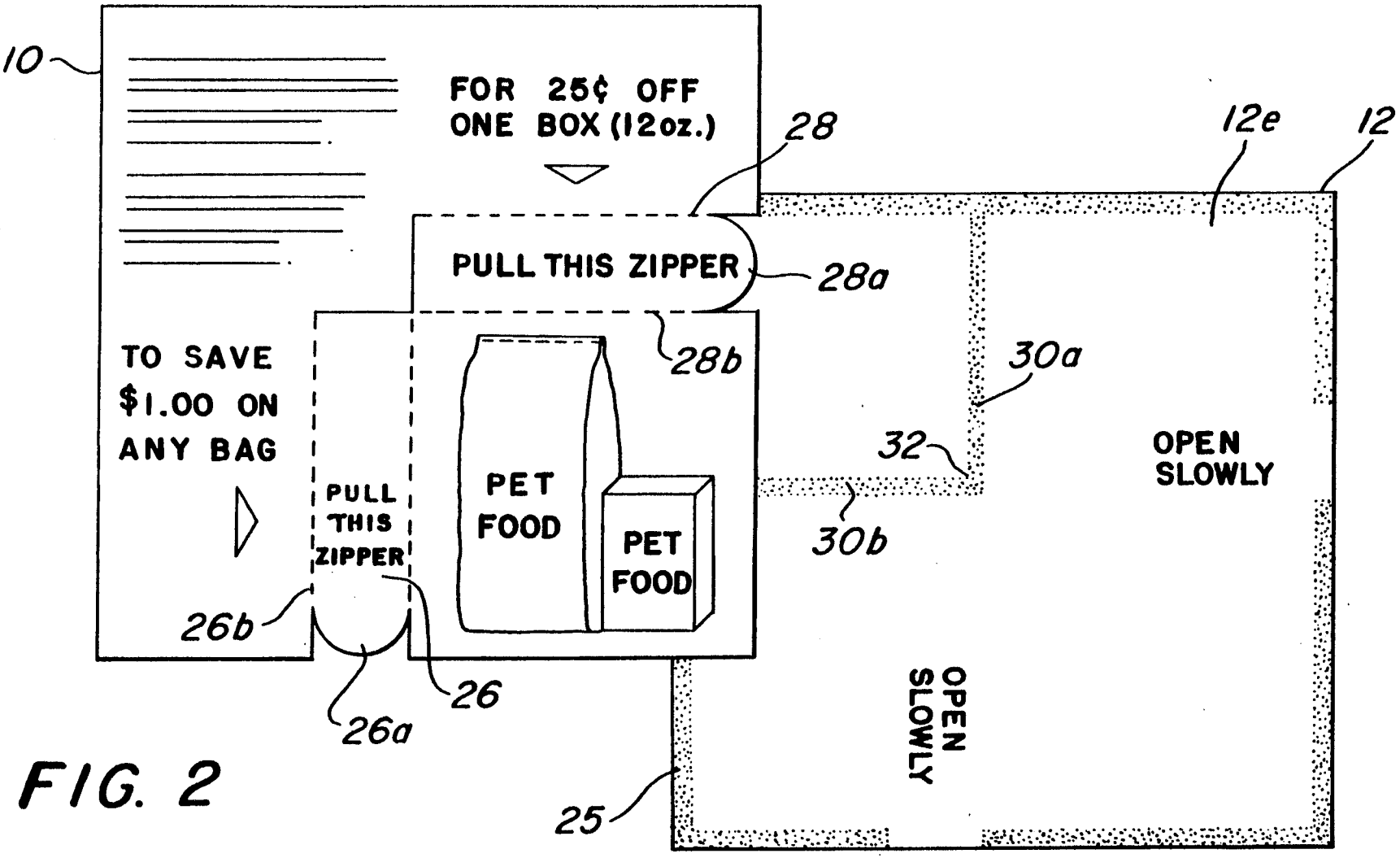
FIG. 2 is an exploded, perspective view of a second preferred embodiment of a couponing system constructed in accordance with the present invention prior to its formation into a product as it is actually used.
Figure 3:
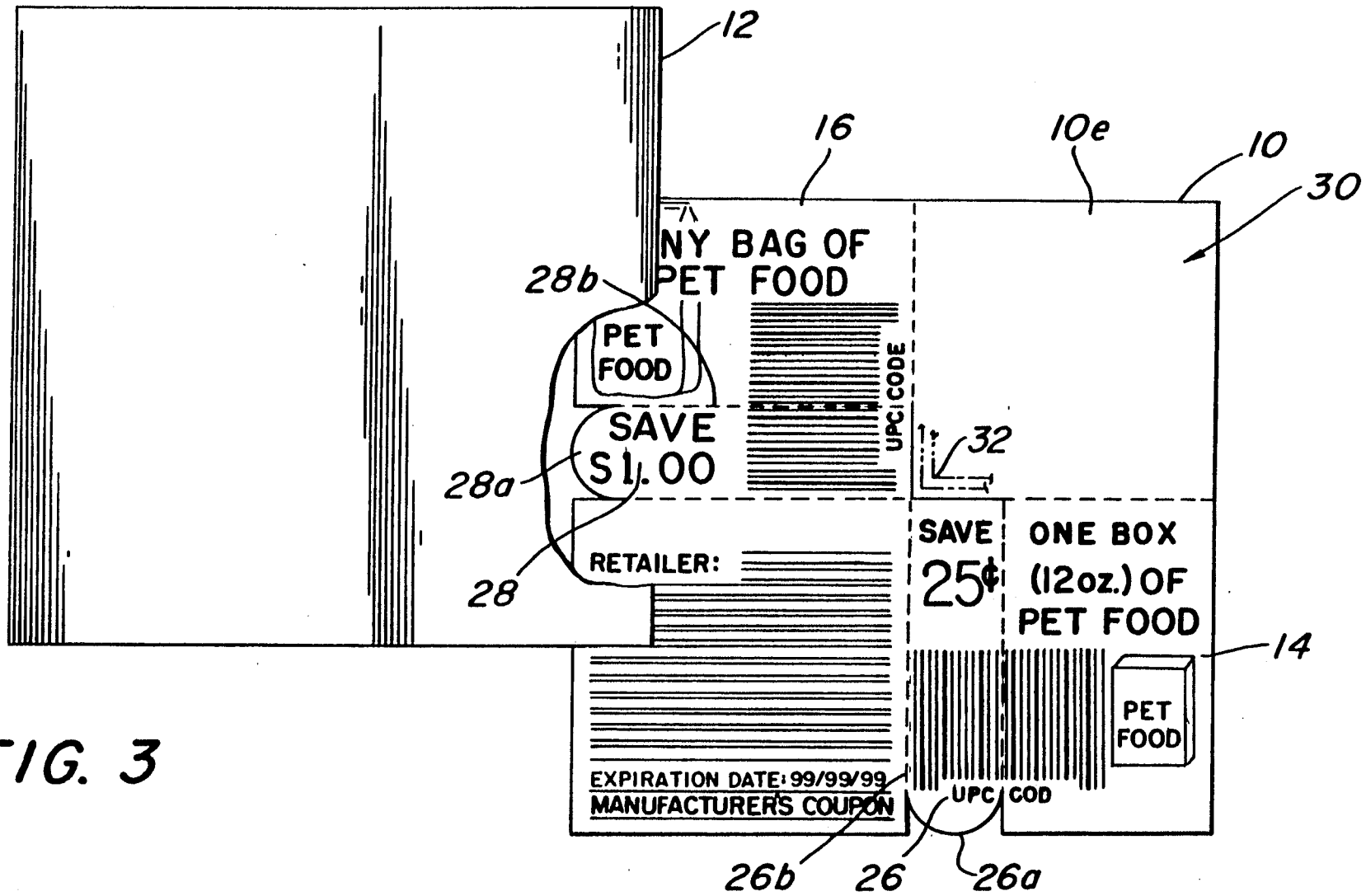
FIG. 3 is an exploded, perspective view of the FIG. 2 couponing system but from an opposite direction.

Referring to FIGS. 1, 2 and 3, a couponing system, constructed in accordance with the present invention, includes first and second sections 10 and 12, respectively, preferably made of paper and being attached to each other along their edges 10*a* and 12*a*, 10*b* and 12*b*, 10*c* and 12*c*, and 10*d* and 12*d*. The attachment of sections 10 and 12 is such that the text on either of the inside surfaces 10*e* and 12*e* of sections of 10 and 12, respectively, which face each other are hidden from view.

Section 10 has first and second coupons 14 and 16, respectively, with the text of the coupons on inside surface 10*e* of section 10. For the embodiment of the invention illustrated in FIGS. 2 and 3, each of the coupons 14 and 16 extends along an edge of section 10. In particular, section 10 is shown as being rectilinear with coupon 14 extending along, and having an edge coextensive with edge 10*c*, while coupon 16, disposed perpendicular to coupon 14, extends along, and has an edge coextensive with edge 10*d*. With this arrangement, coupons 14 and 16 have a common portion in the corner of adjoining edges 10*c* and 10*d*, and this common portion contains the required redemption text.

Section 12 is removably attached to section 10 to permit separation of portions of section 10 from section 12. For the embodiment of the invention illustrated in FIG. 1, sections 10 and 12 are attached along a perforated line 18 along which coupon 16 extends and by adhesive strips 20, 22 and 24 extending along the remaining edges of sections 10 and 12. For the embodiment of the invention illustrated in FIGS. 2 and 3, a fourth adhesive strip 25 is substituted for perforated line 18, so that sections 10 and 12 are removably attached by adhesive strips extending around their entire peripheries, except at selected locations which will be explained below. Instead of using adhesive strips, sections 10 and 12 can be attached by adhesive spots.

A couponing system, constructed in accordance with the present invention, also includes means for tearing section 10 along first and second lines, the first line extending through coupon 14 and displaced from coupon 16 and the second line extending through coupon 16 and displaced from coupon 14. For the embodiment of the invention illustrated in FIGS. 1, 2 and 3, the tearing means are in the form of first and second zipper pulls 26 and 28, respectively, on which the value portions of the coupons are located (i.e. "25¢" on zipper pull 26 and "$1.00" on zipper pull 28). Zipper pulls 26 and 28 are disposed perpendicular to each other and extend from approximately the midpoints of edges 10*c* and 10*d*, respectively, to a location inwardly of opposed edges 10*a* and 10*b*, respectively. In fact, the length of the zipper pulls 26 and 28 are approximately one-half of the length of the section 10 between edges 10*c*–10*a*, and between edges 10*d*–10*a*, respectively. Moreover, the zipper pulls do not intersect each other. It also should be noted that each zipper pull is a perforated portion of section 10, which can be separated from the body along the perforations.

Each of the zipper pulls 26 and 28 has a zipper pull tab end 26*a* and 28*a*, respectively, and a zipper run 26*b* and 28*b*, respectively. When pulled at their respective pull tab ends, at which locations there is no adhesive, the zipper pull separate from section 10 along their respective runs.

Each of the zipper pulls has a width defined by spaced apart lines of weakness, preferably in the form of lines of perforation (i.e., lines 26*c* and 26*d* for zipper pull 26-lines 28*c* and 28*d* for zipper pull 28).

It should be noted that the line of perforations 26*c* constitutes a part of the end edge of coupon 16 and the line of perforations 28*c* constitutes a part of the end edge of coupon 14. A line of weakness, preferably in the form of a line of perforations 26*c*′ constitutes a linear extension of the line of perforations 26*c*, and, along with the line of perforations 26*c* defines the entire marginal edge of the coupon 16. In a similar manner a line of weakness, preferably in the form of a line of perforations 28*c*′ constitutes an extension of the line of perforations 28*c*, and, along with the line of perforations 28*c*, defines the entire marginal edge of the coupon 14.

In accordance with this invention applicant has recognized that the couponing systems described and claimed in copending application Ser. No. 617,504, the subject matter of which has been incorporated by reference herein, could be simplified and improved by reducing the length of the zipper pulls 26 and 28, and designing the zipper pulls so that they more reliably can be pulled along the desired paths, without inadvertently deviating into the wrong coupon. If either zipper pull does deviate into the wrong coupon it either will destroy that coupon, or possibly will destroy both coupons. In accordance with the design of this invention, as will be described in detail hereinafter, the zipper pulls 26 and 28 do not cross or intersect each other as in the system described and claimed in the '504 application, and therefore, there is no need to deal with the problem of effectively cutting selected lengths of the lines of perforations at their points of intersection with each other.

Specifically, applicant has recognized that the arrangement of coupons 14 and 16, in addition to providing a common corner portion containing the required redemption text (i.e. lower left quadrant of section 10 - FIG. 1), also includes an opposed, corner portion 30 which is completely free of any coupon-related information. Thus, applicant recognized that there is absolutely no reason to provide for the removal of any part or segment of the corner portion 30, incident to separating the desired coupon from the section 10. Based upon the recognition of this fact applicant's construction, as described in detail hereinafter, provides an improved arrangement for separating the desired coupon from the sheet 10, while achieving a more tenacious bonding together of the sheets 10 and 12. In particular, the improved arrangement achieves this result with the use of non-intersecting zipper pulls 26 and 28 which are shorter in length than the zipper pulls employed in the embodiments of applicant's '504 pending application.

Referring specifically to FIG. 1, the corner portion 30, which is defined by portions of edges 10*a* and 10*b*, and by lines of perforations 26*c*′ and 28*c*′, is free of any lines of weaknesses in the interior thereof. It should be noted that in the retail couponing systems disclosed in the '504 application, lines of perforations along which the respected zipper pulls 26 and 28 are separated, do extend into the corner region 30. This prior arrangement undesirably increased the length of the zipper pulls as compared to the present invention. The present invention, due to the reduced length of the zipper pulls, minimizes the possibility that the zipper pulls will deviate from the region between the lines of perforations and enter and damage the wrong coupon, when either of the zipper pulls is being pulled along its respective line of perforations.

Still referring to FIG. 1, it also should be noted that the respected zipper pulls 26 and 28 do not intersect each other, as in the system disclosed in the '504 application. The lack of intersecting regions further minimizes the likelihood that the zipper pulls will deviate from their desired path of travel.

Still referring to FIG. 1, adhesive areas 30*a* and 30*b*, employing a fugitive binder, are provided on section 12 (or alternatively on section 10) along lines which, when the sections 10 and 12 are secured together, are disposed contiguous to lines of perforations 26*c*' and 28*c*', outside the area occupied by the coupons 14 and 16. This is illustrated in FIGS. 1 and 3 wherein the location on section 10, of the corner 32 of adhesive areas 30*a* and 30*b* applied to section 12, is illustrated in phantom representation.

The adhesive areas 30*a*, 30*b* can be in the form of continuous lines, as illustrated, and also in the form of a wide variety of different continuous and discontinuous patterns. These adhesive areas 30*a*, 30*b* provide additional—and therefore more tenacious sealing of section 10 to the section 12, than the system described and claimed in applicant's '504 application.

As can be seen in FIG. 1, the zipper pull tabs 26*a* and 28*a* are located adjacent edge 10*c* and 10*d*, remote from the corner portion 30. In this arrangement the rear edge of the zipper pulls 26 and 28 are actually provided by continuous cuts constituting a portion of the lines of perforations 26*c*' and 28*c*', respectively.

It should be noted that the zipper pulls 26 and 28 can be provided with the pull tab end 26*a* and 28*a* adjacent the lines of perforations 28*c*' and 26*a*', respectively, in which case the rear edge of those zipper pulls will be adjacent the peripheral edges 10*c* and 10*d*, respectively, of the section 10. In either arrangement the zipper pulls 26 and 28 do not intersect each other, and are shorter than the corresponding zipper pulls in the retail couponing systems described in the earlier-mentioned '504 application.

The couponing system of the present invention is intended to give a consumer the choice of selecting one of the coupons 14 and 16 which are contained on section 10 but which are concealed from the consumer prior to selection by the consumer. Once the selection is made, the selected coupon remains intact and can be presented for redemption, while the non-selected coupon is destroyed and rendered invalid, thereby preventing double-redemption. Thus, the selection process in using the couponing system of the present invention involves simultaneously making possible the removal of the selected coupon, while destroying and rendering invalid the non-selected coupon.

Coupon selection is made by pulling either zipper pull 26 or zipper pull 28. The zipper pulls are so disposed, relative to coupons 14 and 16, that when zipper pull 26 is pulled, coupon 14 is torn and destroyed and rendered invalid as the value portion (i.e. "25*c*") is taken away from the remainder of the coupon, while coupon 16 remains intact, and when zipper pull 28 is pulled, coupon 16 is torn and destroyed and rendered invalid as the value portion (i.e. "$1.00") is taken away from the remainder of the coupon, while coupon 14 remains intact. By carrying away the value portion of the non-selected coupon, the chances of improperly redeeming the non-selected coupon are reduced greatly, if not eliminated entirely, because the non-selected coupon is truly invalidated by obviously lacking the redemption value.

When one or the other of the zipper pulls is pulled, text on the inside surface 12*e* of section 12 is exposed and revealed to the user, instructing the user how to remove the selected coupon. This is done by gently pulling the selected coupon away from section 12. Text which instructs the user on how to remove the selected coupon need not be presented on the inside surface of section 12 but instead can be presented on the exposed, outside surface of section 10 along with instructions on which zipper pull is associated with each coupon, or can be presented on the inside surface of section 10 which bears the coupons.

For the embodiment of the invention illustrated in FIG. 1, when coupon 14 is chosen, the adhesive bond along the lower one-half of edges 10*b* and 12*b*, and the adhesive bond along the entire length of edges 10*c* and 12*c* are broken, and perforated line 18 is torn along one half its length. In addition the perforated line 28*c*' is torn along its length. When coupon 16 is selected, the adhesive bond along one-half the length of edges 10*a* and 12*a*, and the adhesive bond along one-half the length of edges 10*c* and 12*c* are broken, and perforated line 18 is torn along its entire length. In addition the perforated line 26*c*' is torn along its length.

For the embodiment of the invention illustrated in FIGS. 2 and 3, the adhesive bond 25 along the strip substituted for perforated line 18 is broken, along with the other adhesive bonds, as the chosen coupon is separated from section 12. The nature of the adhesive selected for the couponing system is such that it serves as a bond in attaching sections 10 and 12 together and withstands the tendency of sections 10 and 12 to separate as one of the zipper pulls is pulled, but the adhesive bond is easily broken as a selected portion of section 10 is gently pulled away from section 12. Any of a variety of fugitive adhesives may be used as the adhesive.

However, due to the additional adhesive attachment of the corner portion 30 of section 10 to the overlying portion of section 12, through fugitive adhesive areas 30*a* and 30*b*, it is not easy to separate (e.g., tamper with) the couponing system prior to its intended use. In fact, any attempt to improperly separate the sections 10 and 12 from each other may virtually destroy the couponing system. This is a further advantage of the present invention, which is not achieved by the retail couponing systems described in applicant's earlier application Ser. No. 617,504.

The embodiments of the present invention illustrated in FIGS. 1, 2 and 3 indicate the applicability of the present invention to an option or self-destruct coupon of the type which reveals the values of the coupons on the outside surface of the couponing system, but which hides the text of the coupons themselves from the consumer until coupon selection is made. The overall physical arrangement and the layout of the couponing system text, including hiding of coupons themselves, reduces, if not eliminates, customer confusion. Instead of having to discern the individual boundaries of overlapping coupons, which is the common arrangement, the consumer needs only to pull one zipper pull or the other consistent with his or her selection and a coupon is selected from the hidden, overlapping coupons.

Figure 4:
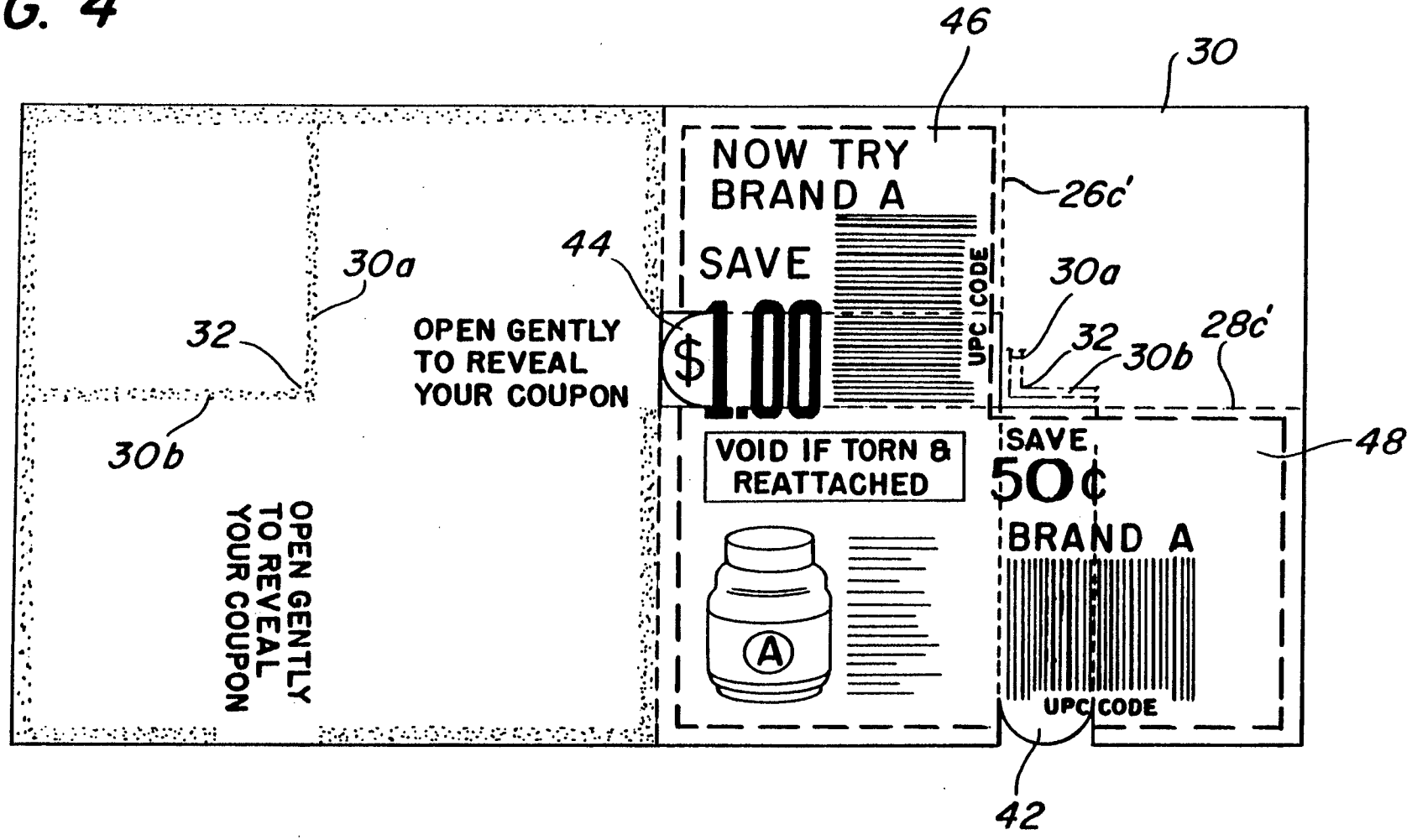
FIG. 4 is a plan view of a third preferred embodiment of a couponing system constructed in accordance with the present invention prior to its formation into a product as it is actually used.
Figure 5:
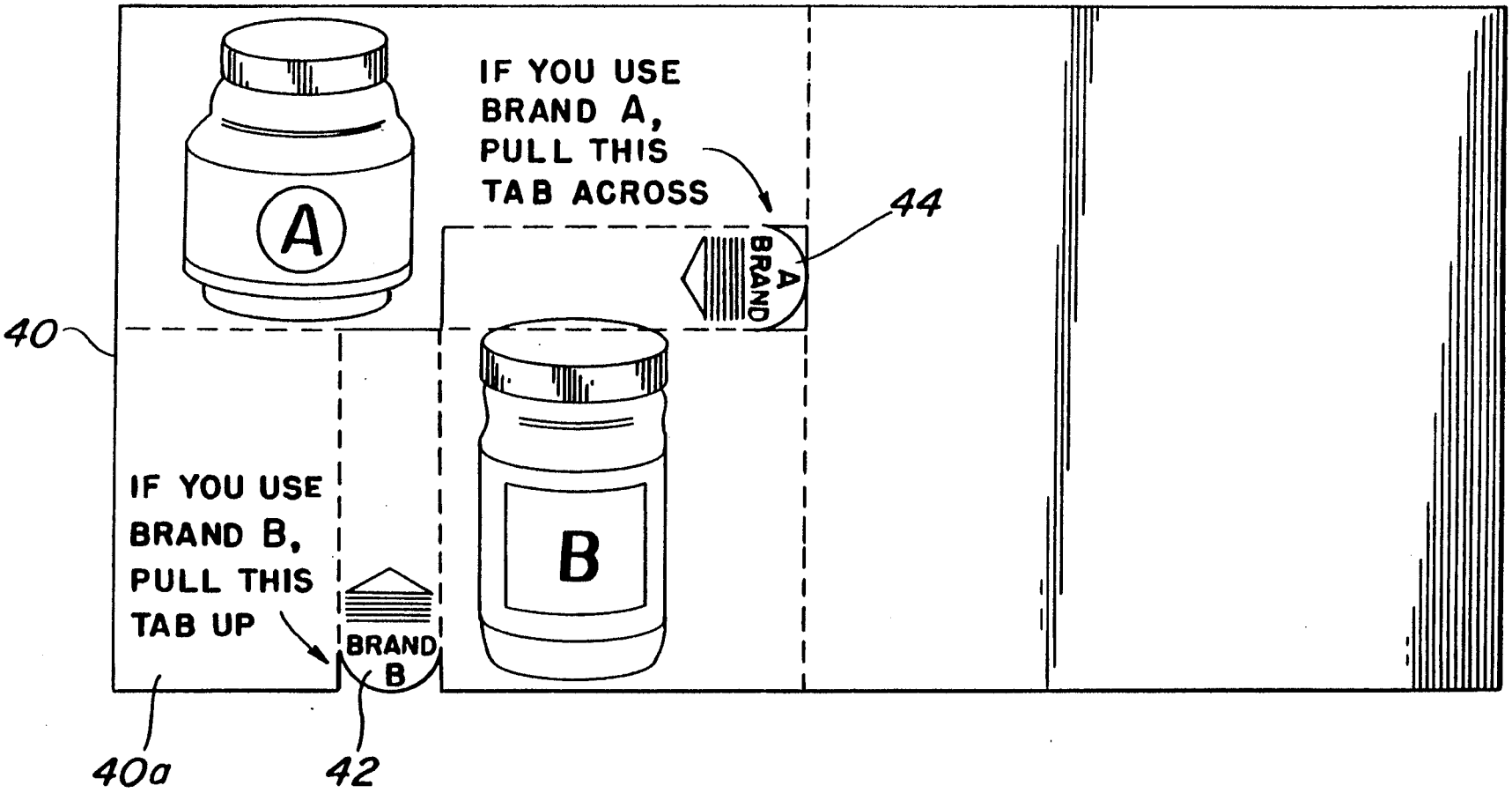
FIG. 5 is a plan view of the reverse side of the FIG. 4 couponing system.

The present invention also is applicable to option or self-destruct coupons of the type which hide the values of the coupons. FIGS. 4 and 5 illustrate the application of the present invention to such a couponing system. A consumer selects between two brands, illustrated on the outside surface 40*a* of a section 40, by pulling one of the two zipper pulls 42 and 44. These zipper pulls are identical in function, form, and operation to zipper pulls 26 and 28 described earlier herein. In pulling one of the two zipper pulls, one of two coupons 46 or 48, on the opposite, inside surface of section 40, is selected as with the FIGS. 1, 2 and 3 embodiments of the invention. Again, the coupons are hidden from the consumer, so that the coupon arrangement will not cause the consumer to become confused about the selection process itself. In contrast with the FIGS. 1, 2 and 3 embodiments, in the embodiment of FIGS. 4 and 5, the values of the coupons also are hidden from the consumer until the selection process is completed.

In the embodiment of the invention illustrated in FIGS. 4 and 5, the value portions of the coupons (i.e. "$.50" and "$1.00") extend beyond the bounds of zipper pulls 42 and 44. As a result, the zipper pulls, extending along lines which extend through coupons 46 and 48, carry away only parts of the value portions of the coupons as one coupon is being selected and the other is being torn, destroyed and invalidated. Besides reducing the chances for improper redemption of an invalid coupon, as with the embodiments of the invention illustrated in FIGS. 1, 2 and 3, the FIG. 5 embodiment makes it more difficult for the user to determine the value of the invalid, non-selected coupon which, under certain circumstances, is a highly desirable result.

As in the previously described embodiments of this invention, the corner portion 30 of section 40 is free of any coupon-related information, and is permanently secured to its overlying sheet through adjoining adhesive lines 30*a* and 30*b* to provide a permanent, non-releasable interconnection. Moreover, as is illustrated in phantom representation in FIG. 4, the adhesive lines 30*a* and 30*b* actually engage the section 40 in regions adjacent lines of perforations 26*c*′ and 28*c*′, in the same manner as in the embodiments disclosed in FIGS. 1–3. Therefore, the embodiment illustrated in FIGS. 4 and 5 has the same benefits resulting from reduced length, non-intersecting zipper pulls, as described in detail in connection with the embodiments disclosed in FIGS. 1–3.

Although the preferred embodiments of the invention have been illustrated as having square shapes, other configurations, such as the rectangle, can be employed.

While in the foregoing there have been described preferred embodiments of the present invention, it should be obvious to those skilled in the art that various modifications and changes can be made without departing from the true spirit and scope of the invention.

What is claimed as the invention is:

1. A couponing system having first and second sections attached to each other to hide from view text on the inside surface of said first section, said first section having a first dimension defined between a first pair of spaced apart edges and a second dimension defined between a second pair of spaced apart edges, said first section having first and second coupons with text of said coupons on the inside surface of said first section, said first and second coupons each including a first edge extending along an edge of a pair of spaced apart edges of said first section and being dimensioned to include a second edge terminating inwardly of the other edge of said pair of spaced apart edges of the first section, said first and second sections being secured together in regions outside the boundaries of the first and second coupons and contiguous to the second edges of said first and second coupons, said second edges of said first and second coupons each being provided by a line of weakness through said first section along which said first and second coupons can be separated from said first section and means for tearing said first section along first and second lines, said first line being displaced from said second coupon and extending through said first coupon from the first edge of said first coupon to the second edge of said first coupon and terminating adjacent to the region in which the first and second sections are secured together contiguous to the second edge of the first coupon, said second line being displaced from said first coupon and extending through said second coupon from the first edge of said second coupon to the second edge of said second coupon and terminating adjacent to the region in which the first and second sections are secured together contiguous to the second edge of the second coupon.

2. A couponing system according to claim wherein said tearing means include a first zipper pull extending along said first line and a second zipper pull extending along said second line.

3. A couponing system according to claim 2 wherein said first and said second zipper pulls each have spaced-apart side edges defined by lines of weakness, a forward pulling edge adapted to be gripped and pulled by a user, said forward pulling edge being adjacent one of said first and second edges of the coupon through which the zipper pull extends and a rear base adjacent the other of said first and second edges of the coupon through which the zipper pull extends.

4. The couponing system of claim 3, wherein the forward pulling edge of each zipper pull is contiguous to the first edge of the coupon through which said zipper pull extends, and the rear base edge is provided by a cut through the first section contiguous to the second edge of the coupon through which said zipper pull extends.

5. A couponing system according to claim 1 wherein said first and said second coupons extend perpendicular to each other and said first and said second lines extend perpendicular to each other.

6. A couponing system according to claim 1 wherein said first and said second sections are rectilinear.

7. A couponing system according to claim 6 wherein:

(a) said first and said second sections are substantially identical in shape, (b) said first and said second coupons extend perpendicular to each other along adjoining edges of said first section, and (c) said first and said second lines extend perpendicular to each other.

8. A couponing system according to claim 7 wherein said tearing means include a first zipper pull extending along said first line and a second zipper pull extending along said second line.

9. A couponing system according to claim 8 wherein said first and said second zipper pulls each have spaced-apart side edges defined by lines of weakness, a forward pulling edge adapted to be gripped and pulled by a user, said forward pulling edge being adjacent one of said first and second edges of the coupon through which the zipper pull extends and a rear base adjacent the other of said first and second edges of the coupon through which the zipper pull extends.

10. The couponing system of claim 1 wherein said first and second sections also are secured to each other along the edges of the first and second pairs of edges.

11. The couponing system of claim 10 wherein a segment of the first section free of any portion of the first and second coupons is circumscribed by the regions of the first section secured to the second section contiguous to the second edge of the first and second coupons and by a portion of adjacent edges of the first and second pairs of spaced apart edges, respectively.

12. The couponing system of claim 11 wherein the first and second sections are rectilinear and the segment of the first section free of any portion of the first and second coupons is a corner segment of said first section.

13. The couponing system of claim 3 wherein a line of weakness defining one of the spaced apart side edges of the first zipper pull constitutes a part of the second edge of the second coupon, and a line of weakness defining one of the spaced apart side edges of the second zipper pull constitutes a part of the second edge of the first coupon.

14. A couponing system according to claim 1 wherein said first and said second sections also are secured to each other by a perforated line along which one of said coupons extends and by adhesive strips extending along the remaining three edges of at least one of said first and second sections.

15. A couponing system according to claim 1 wherein said first and said second sections also are secured to each other by adhesive strips extending along the four edges of at least one of said first and said second sections.

16. A couponing system according to claim 2 wherein said second section contains text on its inside surface facing said inside surface of said first section which is revealed to a user when either of said zipper pulls is pulled to expose said text.

17. A couponing system according to claim 1 wherein each of said coupons has a value portion and said first line extends through the value portion of said first coupon and said second line extends through the value portion of said second coupon.

18. A couponing system according to claim 17 wherein said tearing means include a first zipper pull extending along said first line through said value portion of said first coupon and a second zipper pull extending along said second line through said value portion of said second coupon.

19. A couponing system according to claim 18 wherein said first zipper pull contains the entire value portion of said first coupon and wherein said second zipper pull contains the entire value portion of said second coupon.

20. A couponing system according to claim 18 wherein a part of said value portion of said first coupon extends beyond the bounds of said first zipper pull and a part of said value portion of said second coupon extends beyond the bounds of said second zipper pull.

* * * * *